US008231359B2

(12) United States Patent
Merz et al.

(10) Patent No.: US 8,231,359 B2
(45) Date of Patent: Jul. 31, 2012

(54) PUMP UNIT COMPRISING A MAIN PUMP AND A CHARGE PUMP WITH A VARIABLE PUMP CAPACITY

(75) Inventors: Stefan Merz, Hechingen (DE); Ulrich Gordon Mohn, Horb (DE); Rene Constantin Scheerer, Freudenstadt (DE); Martin Josef Zug, Hirrlingen (DE)

(73) Assignee: Robert Bosch GmbH, Stuttgart (DE)

( * ) Notice: Subject to any disclaimer, the term of this patent is extended or adjusted under 35 U.S.C. 154(b) by 219 days.

(21) Appl. No.: 12/595,547

(22) PCT Filed: Apr. 22, 2008

(86) PCT No.: PCT/EP2008/054864

§ 371 (c)(1),
(2), (4) Date: Oct. 12, 2009

(87) PCT Pub. No.: WO2008/138711

PCT Pub. Date: Nov. 20, 2008

(65) Prior Publication Data

US 2010/0119383 A1 May 13, 2010

(30) Foreign Application Priority Data

May 16, 2007 (DE) ..... 10 2007 022 949
Jul. 10, 2007 (DE) ..... 10 2007 032 103

(51) Int. Cl.
*F04B 23/10* (2006.01)
*F04B 49/12* (2006.01)
*F04C 14/02* (2006.01)

(52) U.S. Cl. ..... 417/206; 417/205; 417/220; 417/269; 417/429; 418/30; 418/31

(58) Field of Classification Search ..... 417/205, 417/220, 206, 429; 418/30, 31
See application file for complete search history.

(56) References Cited

U.S. PATENT DOCUMENTS

| | | | | |
|---|---|---|---|---|
| 1,877,091 | A | 9/1932 | Vickers | |
| 2,769,393 | A | 11/1956 | Cardillo et al. | |
| 5,183,392 | A * | 2/1993 | Hansen | 417/203 |
| 2001/0036412 | A1 * | 11/2001 | Konishi | 417/220 |
| 2003/0007875 | A1 * | 1/2003 | Watanabe et al. | 417/220 |
| 2003/0185687 | A1 | 10/2003 | Lemmen | |
| 2005/0100448 | A1 * | 5/2005 | Graf et al. | 417/273 |

FOREIGN PATENT DOCUMENTS

| | | |
|---|---|---|
| DE | 1 107 085 | 5/1961 |
| DE | 100 45 118 | 3/2002 |
| DE | 103 53 027 | 6/2005 |
| GB | 2 150 981 | 7/1985 |

* cited by examiner

*Primary Examiner* — Devon C Kramer
*Assistant Examiner* — Dominick L Plakkoottam
(74) *Attorney, Agent, or Firm* — Michael J. Striker

(57) ABSTRACT

A pump unit includes a main pump (4) and a charge pump (5), the pump capacity of which is adjustable via an adjusting element. To adjust the pump capacity of the charge pump (5), an adjusting element of the charge pump (5) is acted upon by an adjusting force which is dependent on the inlet pressure of the main pump (4).

8 Claims, 2 Drawing Sheets

PUMP UNIT COMPRISING A MAIN PUMP AND A CHARGE PUMP WITH A VARIABLE PUMP CAPACITY

CROSS-REFERENCE

The invention described and claimed hereinbelow is also described in PCT/EP2008/054864, filed on Apr. 22, 2008 and DE 10 2007 022 949.8, filed May 16, 2007 and DE 10 2007 032 103.3, filed Jul. 10, 2007. These German Patent Applications, whose subject matter is incorporated here by reference, provides the basis for a claim of priority of invention under 35 U.S.C. 119 (a)-(d).

BACKGROUND OF THE INVENTION

The present invention relates to a pump unit comprising a main pump and a charge pump having a variable pump capacity.

Publication DE 100 45 118 A1 makes known a hydraulic system comprising a main pump and a precompression pump. The hydraulic system presented therein includes two pumps in a serial arrangement, it being possible to adjust the pump capacity of each of the two pumps. The precompression pump, the delivery side of which is connected to an inlet line of the main pump, may be adjusted using an adjusting device. An open-loop or closed-loop control device which acts on a related adjusting mechanism of the precompression pump is provided for this purpose.

Publication GB 21 50 981 A also makes known a system which includes two pumps located in series. A charge pump suctions pressure medium out of a tank volume and delivers it via a connecting line to a main pump. Both the precompression pump and the main pump are designed to be variable, and each one includes a control device. An electronic control unit controls is provided to control the control device of the charge pump and the control device of the main pump.

In the known hydraulic systems that include two serially connected hydraulic pumps, it is disadvantageous that the pump capacity of the first pump, which supplies the second pump with pressure medium, is not regulated as a function of the pressure that acts on the inlet side of the second pump. Therefore, the control mechanisms only indirectly take into account the operating situation of the total system, which is composed of both pumps.

Furthermore, publication DE 103 53 027 A1 makes known a simple vane pump, in the case of which a pressure differential between a delivery pressure and an intake pressure acts on a stroke ring. The stroke ring may be displaced in a translational manner, and it is acted upon by the delivery-side pressure on one side, and, on the other side, by the pressure that is present on the intake side of the vane pump.

SUMMARY OF THE INVENTION

The present invention is based on the object of creating a pump unit which includes a main pump and a charge pump having a variable pump capacity, in the case of which the pump capacity of the charge pump is adjusted rapidly when the operating conditions of the main pump change.

The pump unit according to the present invention comprises a main pump and a charge pump having a variable pump capacity. An adjusting means is provided for adjusting the pump capacity of the charge pump; the adjusting means is acted upon with an adjusting force that is dependent on an inlet pressure of the main pump. By generating an adjusting force that is dependent on the pressure present at the inlet side of the main pump, it is ensured that there is an immediate reaction to the adjustment of the pump capacity of the charge pump if the inlet pressure of the main pump changes. In this manner it is possible to prevent pressure spikes, and it is ensured that an undersupply of the main pump and, therefore, an occurrence of cavitation are reliably prevented. This has a positive effect on the service life of the main pump. The decisive factor is that the pump capacity is adjusted as a function of the pressure on the inlet side. Pressure fluctuations that are due, e.g., to a filter located between the main pump and the charge pump, have no effect.

The adjusting means for changing the pump capacity of the charge pump is preferably a stroke ring. A means of this type for adjusting the charge pump using a stroke ring may be situated in the pump unit easily and in a space-saving manner.

The charge pump is preferably located in a recess in a housing part, and a pressure chamber is formed between the recess in the housing part and the stroke ring; the pressure chamber is acted upon with an adjustment pressure to produce the adjusting force. Via the pressure chamber situated between the recess in the housing part and the stroke ring, it is possible to produce an adjusting force directly on the stroke ring by producing an adjustment pressure. It is therefore not necessary to utilize an elaborate method for producing an adjusting force, e.g., using electromagentic actuating elements or an additional actuating piston which is acted upon with a hydraulic force.

It is advantageous, in particular, when the housing part is a terminal plate of the pump unit, and the pressure chamber is connected to an inlet line of the main pump. In this manner, the adjusting force is generated directly by the pressure present on the inlet side of the main pump, which is therefore also the adjustment pressure. It therefore becomes superfluous to detect—using laborious means—a pressure present on the inlet side of the main pump and to subsequently generate an adjusting force. It is also advantageous that a rapid reaction is ensured via the direct correlation between the adjusting force and the pressure present on the inlet side of the main pump.

According to a further preferred embodiment, a groove is formed on an outer circumference of the stroke ring, in a subregion of the pressure chamber. By using a groove of this type, it is ensured that the adjustment pressure may be applied to the pressure chamber even when the stroke ring is displaced in the direction of its end position; via the groove in the stroke ring, it is ensured that a sufficient amount of surface area is available for displacement. The reaction times to a change in pressure are therefore reduced even when the stroke ring is in an extreme position, and a dynamically variable pump capacity of the charge pump is attained.

The inlet line of the main pump is preferably designed, via the pressure chamber, as a channel in the terminal plate. As the result of a direct connection of this type between the inlet line and the pressure chamber, the line length is particularly short. As a result, pressure losses are reduced, which, in turn, results in a better response behavior of the pump capacity regulation of the charge pump.

It is also advantageous to form a guide region between the stroke ring and the recess that accommodates the stroke ring and/or the entire charge pump. A guide region of this type ensures that the stroke ring is guided exactly in the recess. An exact guidance of the stroke ring ultimately results in improved control behavior, since uneven control behavior does not occur, as could happen, e.g., if a stroke ring having a circular outer geometry were out-of-round. A stroke ring of this type that has a circular outer geometry may rotate during operation of the pump unit. Due to the fluctuation of the gap widths between the stroke ring and the recess in the housing part, different pressure losses caused by pressure medium leaking out of the pressure chamber result, depending on the position of the stroke ring. This has a negative effect on the response behavior and, in particular, on the reproducibility of the adjustment of the pump capacity. Although unilateral guidance is basically sufficient to prevent the stroke ring from rotating relative to the housing part in which the charge pump is located, symmetrical guidance of the stroke ring is preferred. For this purpose, the stroke ring includes two flat sections which are parallel to one another, and two corresponding flat sections are provided in the recess of the housing part.

According to a further preferred embodiment, the stroke ring is also acted upon with a restoring force. The restoring force acts on the stroke ring with a direction of force that is oriented parallel to the flat sections of the housing. The resistance that acts between the stroke ring and the housing ring due to the friction of the stroke ring in the recess in the housing part is therefore low and, in particular, is not dependent on the position of the stroke ring.

In particular, it is preferred that the stroke ring is acted upon with a restoring force, and the direction of the restoring force is perpendicular to a hydraulic force generated by a delivery-side inner pressure on the stroke ring. It is particularly preferred for the hydraulic force generated by the pressure on the inner side of the stroke ring to be simultaneously perpendicular to a mating surface formed by the flat section. The force generated in the interior of the stroke ring via the delivery pressure may therefore be reliably supported by the flat section. The force generated by the delivery pressure on the stroke ring therefore does not affect the control. An improvement of the control behavior is attained, since it is only dependent on the restoring force and the inlet pressure of the main pump.

BRIEF DESCRIPTION OF THE DRAWINGS

A preferred embodiment is explained in greater detail in the description that follows, with reference to the drawing.

DETAILED DESCRIPTION OF THE PREFERRED EMBODIMENTS

Figure 1:
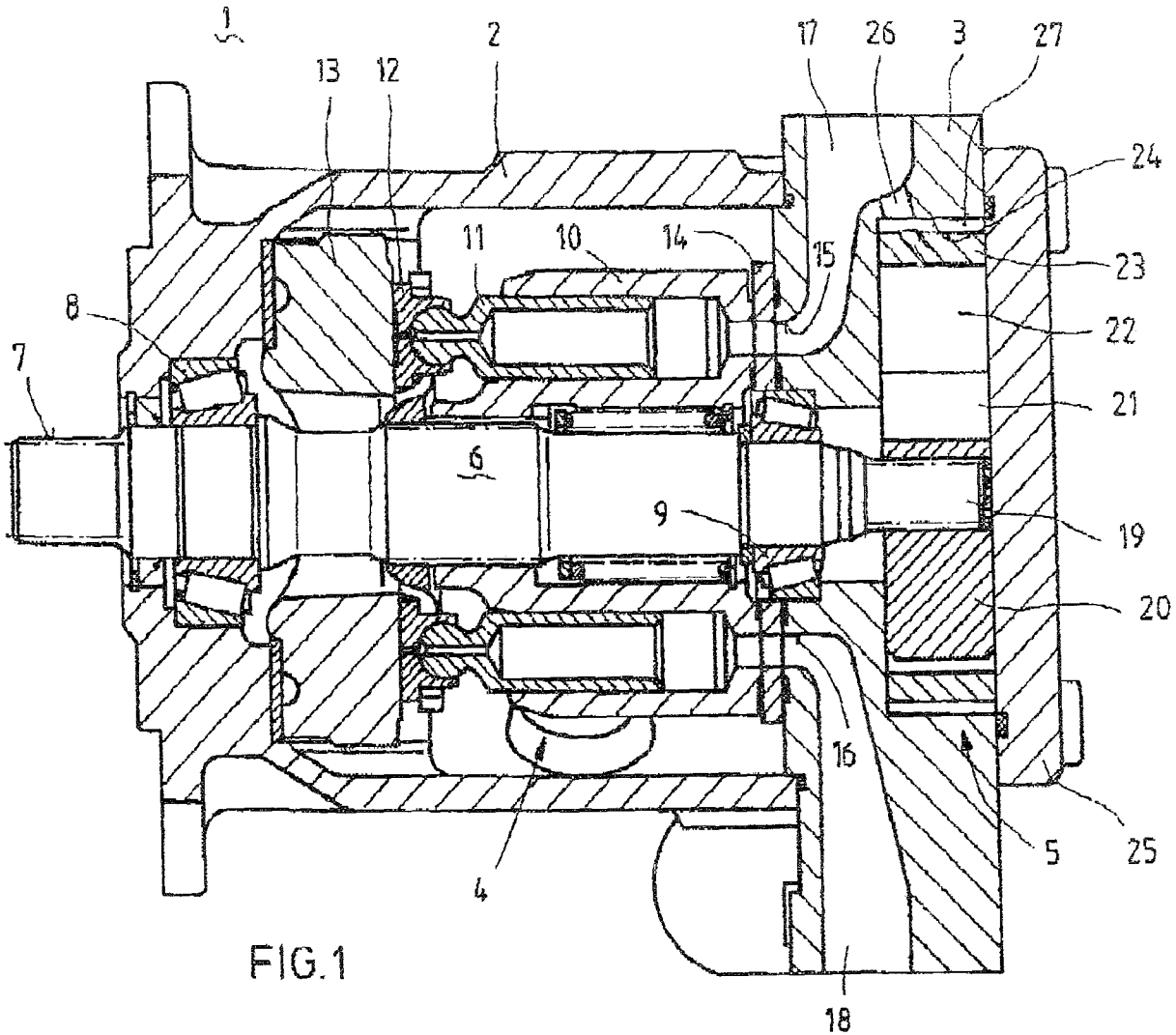
FIG. 1 shows a longitudinal sectional view through a pump unit, according to the present invention, which includes a main pump and a variable charge pump.

FIG. 1 shows a preferred embodiment of a pump unit 1, according to the present invention, which includes a housing having a pot-shaped housing part 2 and a further housing part that closes pot-shaped housing part 2. The further housing part is designed as terminal plate 3. A main pump 4 is located in the interior of pot-shaped housing part 2. A charge pump 5 is located in a side of terminal plate 3 that faces away from pot-shaped housing part 2.

Main pump 4, which is designed as an axial piston machine in the embodiment shown, and charge pump 5 are driven by a common drive shaft 6. Drive shaft 6 includes a shaft end which extends out of pot-shaped housing part 2 in the region of the base. Toothing 7 is formed on the shaft end of drive shaft 6. Toothing 7 is used to non-rotatably connect drive shaft 6 to a device which generates torque.

Common drive shaft 6 is rotatably supported in the housing of pump unit 1 using a first bearing 8 and a second bearing 9, and is therefore rotatable around an axis of rotation. First bearing 8 is located in the base of pot-shaped housing part 2. Second bearing 9 is located in terminal plate 3 on the side of terminal plate 3 facing the inner chamber of pot-shaped housing part 2.

A cylindrical drum 10 is non-rotatably connected to common drive shaft 6. Several cylindrical bores are formed in cylindrical drum 10. The cylindrical bores are distributed around a peripheral circle, and they extend parallel to the rotational axis. A piston 11 is situated in each of the cylindrical bores in a longitudinally displaceable manner. A sliding block 12 is hingedly connected to each piston 11, via which piston 11 bears against a swashplate 13. Swashplate 13 has a running surface against which sliding block 12 bears in a sliding manner when cylindrical drum 10 rotates. Depending on an angle that the running surface of swashplate 13 forms with the rotational axis of common drive shaft 6, pistons 11 perform a reciprocating motion in the cylindrical bores in cylindrical drum 10.

The cylindrical bores are open front side of cylindrical drum 10 facing away from swashplate 13. When cylindrical drum 10 rotates, the cylindrical bores communicate via openings in control plate 14 with either a first control opening 15 or a second control opening 16. First control opening 15 and second control opening 16 are kidney-shaped. First and second control openings 15, 16 form a first pair of control openings 15, 16. First control opening 15 is connected to an inlet line 17, and second control opening 16 is connected to an outlet opening 18. Via first control opening 15, pressure medium is drawn out of inlet line 17 when piston 11 performs a reciprocating motion that increases the volume of the cylindrical bore. Conversely, when the piston performs a reciprocating motion that reduces the volume of the cylindrical bore, the pressure medium is forced via control plate 14 into second control opening 16. A location pin may be provided, e.g., to prevent control plate 14 from rotating relative to terminal plate 3.

Furthermore, cylindrical drum 10 is acted upon via a spring force in the direction toward the control plate, thereby ensuring that the front side of cylindrical drum 10, which faces away from swashplate 13, bears in a sealing manner against control plate 14.

Common drive shaft 6 includes an exposed shaft end 19. Exposed shaft end 19 extends through second bearing 9 and into a stepped recess 24 in terminal plate 3. Stepped recess 24 in terminal plate 3 accommodates the components of charge pump 5 on its side facing away from the interior of the housing. Rotor 20 is mounted on exposed shaft end 19. In the embodiment shown, charge pump 5 is designed as a vane pump. Rotor 20 is mounted on exposed shaft end 19 of common drive shaft 6 with the aid of a torque-transferring device. In the simplest example a torque-transferring device of this type may be a multitooth connection or a splined shaft connection. For this purpose, a driving toothing is formed on exposed drive shaft end 19, which engages in a corresponding driving bearing of rotor 20.

In the preferred embodiment shown, charge pump 5 is designed as a vane pump. For this purpose, a plurality of grooves is formed in rotor 20, in the radial or approximately radial direction. One of the grooves 21 is visible in the sectional view shown. A movable element 22 is located in each of the grooves. When rotor 20 rotates, centrifugal force radially-displaceable, movable element 22 to move outwardly in the radial direction, with the result that it bears in a sealing manner against an inner circumferential surface of a stroke ring 23.

Stroke ring 23 is displaceable in terms of its relative length with respect to the rotation axis of common drive shaft 6 and, therefore rotor 20. The eccentric position of stroke ring 23 is adjusted via an adjusting force of an actuating device and a force of a restoring device, which is not shown in FIG. 1, said force acting on stroke ring 23 in the opposite direction. The position and design of the actuating device and/or the restoring device are explained in greater detail, below, with reference to FIG. 2. In the embodiment shown, the pressure present in inlet line 17 is supplied in order to generate an adjusting force on stroke ring 23. For this purpose, inlet line 17 is connected via an adjustment pressure channel 26 to a sickle-shaped gap which forms a pressure chamber. The gap forms between stroke ring 23 and recess 24 on the outwardly-facing side of terminal plate 3. Rotor 20 is also inserted in stroke ring 23, in recess 24. Recess 24 is closed via a cover 25. Cover 25 is sealed, e.g., using an O-ring seal, and it is screwed together with terminal plate 23.

In the embodiment shown, pressure chamber 27 is the actuating device. A spring or a spring assembly, for example, is provided as the restoring device, in a position that is not visible in FIG. 1. The restoring device acts on stroke ring 23 with a force that acts against the hydraulic force generated by the pressure present in inlet line 17 and, therefore, on the inlet side of the main pump.

As explained in greater detail, below, with reference to FIG. 2, recess 24 is longer in one direction than the maximum extension of stroke ring 23 is in this direction. A pressure chamber 27 therefore forms in the region of recess 24, between an outer surface 28 of stroke ring 23 and terminal plate 3. Pressure chamber 27 is connected via an adjustment pressure channel 26 to inlet line 17. Ideally, to attain a particularly short connection between pressure chamber 27 and inlet line 17, adjustment pressure channel 26 is designed as a bore in terminal plate 3, as shown in FIG. 1. The short length of adjustment pressure chamber 26 prevents pressure losses from occurring along adjustment pressure channel 26, with the result that the pressure in pressure chamber 27 is practically always identical to the pressure present in inlet line 17. As a result, stroke ring 23 is acted upon with a related adjustment pressure practically always at the same time when the pressure on the inlet side of main pump 4 changes. As a result, an adjusting force that is dependent on the inlet pressure of main pump 4 is applied immediately to stroke ring 23. The dynamics of charge pump 5 are therefore improved. A pressure drop inside adjustment pressure channel 26 is negligible. The application of an adjusting force on stroke ring 23 via the pressure that bears against the inlet side of main pump 4 in inlet line 17 generally has the advantage that there is a direct correlation between the adjustment of the displacement of charge pump 5 and the pressure present on the inlet side of main pump 4. This eliminates the need, in particular, for separate actuating means that bring stroke ring 23 into a position that corresponds to the pump capacity that was delivered and that is dependent on the inlet-side pressure of main pump 4. The adjusting force is generated directly by the adjustment pressure in pressure chamber 27; pressure chamber 27 is bounded in one direction by stroke ring 23.

Figure 2:
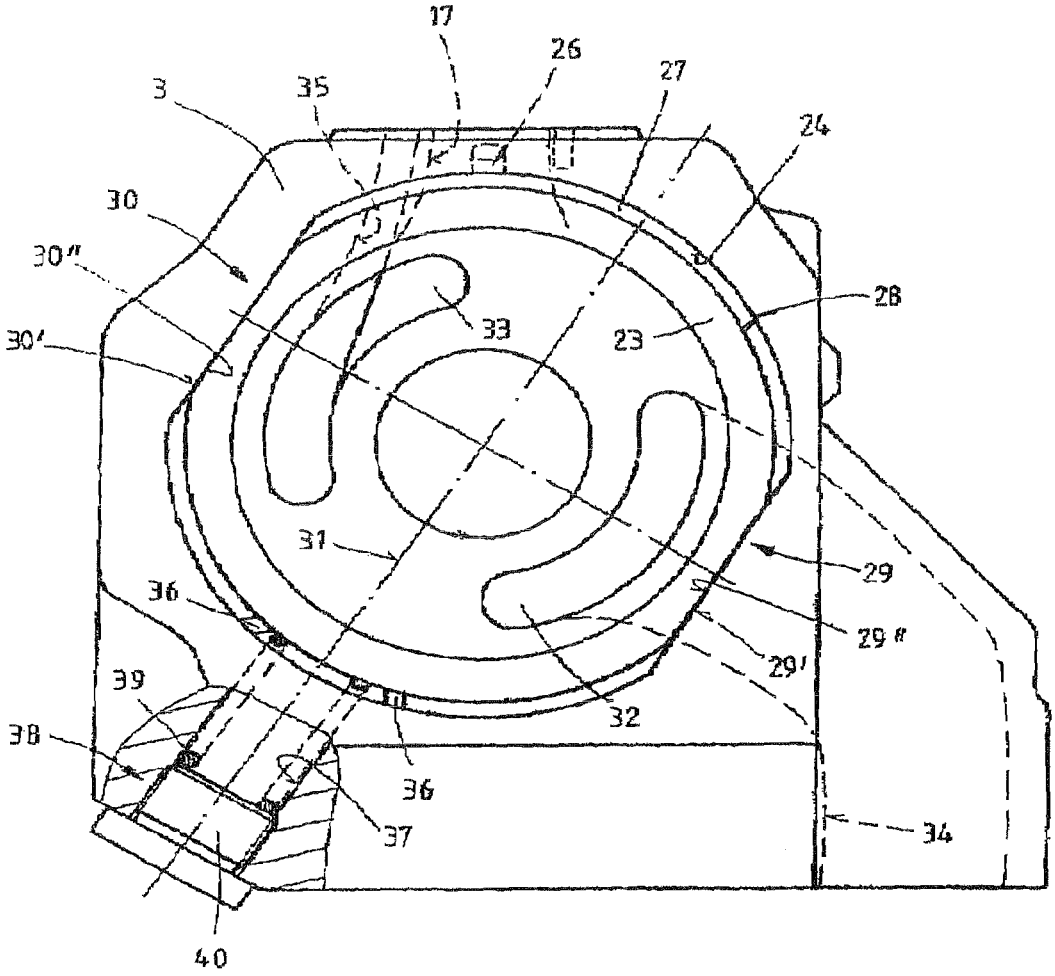
FIG. 2 shows a top view of a terminal plate of the pump unit, according to the present invention, which includes a stroke ring for varying the pump capacity of the charge pump.

Pressure chamber 27 is shown once more in FIG. 2. Pressure chamber 27 forms between outer circumference 28 of stroke ring 23 and terminal plate 3. To enhance clarity, FIG. 2 does not show cover 25 or rotor 20 located in recess 24 in terminal plate 3.

The pump capacity of charge pump 5 is determined via the position of stroke ring 23 in recess 24. Recess 24 is therefore longer in the displacement direction of stroke ring 23 than the longitudinal extension of stroke ring 23. Stroke ring 23 is displaced in the direction of an adjustment axis 31. Stroke ring 23, which has a basically circular cross section, is flattened in two diametrically opposed regions parallel to adjustment axis 31. Flat sections 29', 30', which are created in this manner, of stroke ring 23 correspond to straight sections 29", 30" in recess 24 and interact therewith to form first and second guide regions 29, 30. Guide regions 29, 30 prevent stroke ring 29 from rotating. By preventing stroke ring 23 from rotating, wear is reduced, and, in particular, the precision of the adjustment of the pump capacity of charge pump 5 is increased. In addition, due to the length of the sealing gap in the vicinity vide regions 29, 30, pressure chamber 27 is sealed off in an improved manner from the region formed on opposite side, between outer circumference 28 of stroke ring 23 and recess 24 in terminal plate 3. A pressure loss along guide regions 29, 30 is therefore reduced, thereby improving the precision of adjustment and the response behavior of charge pump 5. By making the adjustment of charge pump 5 dynamic in this manner, the control behavior of entire pump unit 1 is improved, because changing operating conditions that act on the inlet side pressure of main pump 4 directly induce an adjusting motion of stroke ring 23 of charge pump 5.

FIG. 2 shows the preferred embodiment, including two guide regions 29 and 30 located on opposite sides of stroke ring 23, and corresponding recess 24. In an alternative, simplified embodiment, it is also possible to provide a guide region on only one side. The guide region preferably extends parallel to adjustment axis 31; a first control opening 32 and a second control opening 33 are symmetrical around adjustment axis 31. The resultant forces that act on the pressure side on the inner circumferential edge of stroke ring 23 are therefore perpendicular to adjustment axis 31. No force components that result from the delivery pressure act in the displacement direction of stroke ring 23. First control opening 32 and second control opening 33 are both kidney-shaped. First control opening 32 is connected to an intake channel 34 located in a connection arch of terminal plate 3, and, e.g., to a tank volume. The delivery side of charge pump 5 and, therefore, second control opening 33 are connected via an outlet line 35 to inlet line 17 of main pump 4. A filter which is flange-mounted to the outside of terminal plate 3 may be provided in the connection between outlet line 35 and inlet line 17 of main pump 4. Outlet line 35 of charge pump 5 is at least partially designed such that it encloses inlet line 17 of main pump 4, as shown in FIG. 2. Inlet line 17 of main pump 4 is shown only partially, to enhance clarity. As shown clearly in FIGS. 1 and 2, the connection channel, which is adjustment pressure channel 26, between pressure chamber 27 and inlet line 17 of main pump 4 is very short.

To ensure that the pump capacity of charge pump 5 may increase when the pressure drops on the inlet side of main pump and, therefore, when the adjustment pressure and adjusting force in adjustment pressure chamber 27 decrease, stroke ring 23 must be displaced such that it reduces the volume of pressure chamber 27. A restoring device 38 is provided for this purpose. In the embodiment shown, restoring device 38 is simple in design and includes a reset spring 39 and a plunger 40. Plunger 40 is a first spring bearing for reset spring 39. The opposite end of reset spring 39, which is designed as a coiled spring, bears against outer circumference 28 of stroke ring 23 and thereby generates a translatory force that acts on stroke ring 23 in the direction of adjustment axis 31. Reset spring 39 and plunger 40 are inserted into a bore 37 in terminal plate 3. The central axis of bore 37 coincides with adjustment axis 31. The adjustment direction of stroke ring 23 and the direction of force of restoring device 38 are therefore parallel to one another and coincide in the embodiment shown.

To prevent stroke ring 23 in terminal plate 3 from becoming displaced in the direction of diminishing pump capacity as pressure increases, stops 36 are provided in recess 24 that limit the movement of stroke ring 23 in the direction of diminishing pump capacities. Likewise, to prevent stroke ring 23 from interacting in a sealing manner with recess 24 in the region of adjustment pressure channel 26 when pressure diminishes in inlet line 17 of main pump 4, it is preferable to form a groove which extends in the circumferential direction in outer circumference 28 of stroke ring 23 in the region of the pressure chamber or at least in a subregion of pressure chamber 27. The groove extends, in particular, across the opening-out region of adjustment pressure channel 26. This ensures that, even when stroke ring 23 bears against recess 24 of terminal plate 3, a sufficiently large area is acted upon with an adjusting force when the pressure in inlet line 17 of main pump 4 increases. The response behavior is improved as a result, in particular when the pump unit is started up.

The present invention is not limited to the embodiment shown. In particular, advantageous combinations of individual features of pump unit 1 according to the present invention are possible.

What is claimed is:

1. A pump unit, comprising:

a main pump (4), wherein the main pump has an inlet line (17); and a charge pump (5), wherein the charge pump has an outlet line (35), wherein the charge pump (5) is located in a recess (24) in a housing part, wherein a pump capacity of said charge pump is adjustable via an adjusting means, wherein to adjust the pump capacity of the charge pump (5), an adjusting means of the charge pump (5) is acted upon by an adjusting force which is dependent on the inlet pressure of the main pump (4);

a pressure chamber (27) formed between the housing part and the adjusting means, wherein the outlet line (35) of the charge pump is not directly connected to the pressure chamber (27), and wherein the inlet line (17) of the main pump is connected to the pressure chamber (27) via an adjustment pressure channel (26).

2. The pump unit as recited in claim 1, wherein the adjusting means of the charge pump (5) is a stroke ring (23).

3. The pump unit as recited in claim 2, wherein the pressure chamber (27) is acted upon with an adjustment pressure to produce the adjusting force.

4. The pump unit as recited in claim 3, wherein the housing part is a terminal plate (3) of the pump unit (1), and the pressure chamber (27) is connected to an inlet line (17) of the main pump (4).

5. The pump unit as recited in claim 4, wherein the adjustment pressure channel (26) is located in the terminal plate (3).

6. The pump unit as recited in claim 3, wherein at least one guide region (29, 30) is formed via the recess (24) of the housing part which is used to accommodate the charge pump (5) and the stroke ring (23).

7. The pump unit as recited in claim 6, wherein the stroke ring (23) is acted upon with a restoring force via a restoring device (38), the direction of force of which is parallel to the at least one guide region (29, 30), and acts opposite to the adjusting force on the stroke ring (23).

8. The pump unit as recited in claim 2, wherein the stroke ring (23) is acted upon with a restoring force via a restoring device (38), and the direction of the restoring force is perpendicular to a hydraulic force generated by an inner pressure on the stroke ring (23).

* * * * *